US006513705B1

(12) United States Patent
Sheffer

(10) Patent No.: US 6,513,705 B1
(45) Date of Patent: Feb. 4, 2003

(54) FOLD AND GLUE STACKING CONTAINER WITH SIDE ACCESS

(75) Inventor: Phil B. Sheffer, Thomasville, PA (US)

(73) Assignee: Pack 'N' Stack, Philadelphia, PA (US)

( * ) Notice: Subject to any disclaimer, the term of this patent is extended or adjusted under 35 U.S.C. 154(b) by 0 days.

(21) Appl. No.: 10/009,293

(22) PCT Filed: May 7, 1999

(86) PCT No.: PCT/US99/10018

§ 371 (c)(1),
(2), (4) Date: Mar. 13, 2002

(87) PCT Pub. No.: WO00/68098

PCT Pub. Date: Nov. 16, 2000

(51) Int. Cl.[7] ..... B65D 5/24; B65D 21/032

(52) U.S. Cl. ..... 229/178; 206/509; 229/120.26; 229/164; 229/187; 229/918; 229/919

(58) Field of Search ..... 229/120.26, 164, 229/178, 186, 187, 915, 918, 919; 206/509, 511, 512

(56) References Cited

U.S. PATENT DOCUMENTS

| | | | | | |
|---|---|---|---|---|---|
| 2,339,445 | A | * | 1/1944 | Wynne et al. | 229/918 |
| 2,963,210 | A | * | 12/1960 | Gilmore, Sr. | 229/178 |
| 2,965,279 | A | * | 12/1960 | Campbell | 229/915 |
| RE25,050 | E | | 10/1961 | Hamilton | |
| 3,036,753 | A | * | 5/1962 | Davis et al. | 206/509 |
| 3,055,573 | A | * | 9/1962 | Carter | 229/918 |
| 3,102,674 | A | | 9/1963 | Hamilton | |
| 3,904,106 | A | * | 9/1975 | Elder | 229/178 |
| 4,844,331 | A | * | 7/1989 | Oldfather | 229/178 |
| 5,052,615 | A | * | 10/1991 | Ott et al. | 229/918 |
| 5,522,502 | A | * | 6/1996 | Orr et al. | 229/178 |

FOREIGN PATENT DOCUMENTS

| | | | | |
|---|---|---|---|---|
| EP | 394544 A1 | * | 10/1990 | 229/164 |
| GB | 2085405 | | 4/1982 | |

OTHER PUBLICATIONS

Copy of International Search Report.

* cited by examiner

*Primary Examiner*—Gary E. Elkins
(74) *Attorney, Agent, or Firm*—Duane Morris, LLP

(57) ABSTRACT

A preferably one-piece fold-and-glue container has corners reinforced by extensions that fold over and compress self-erecting bellows or gusset corner joints, and cutouts in each of the four front, back and end walls. The corrugated paperboard panels of a single flat blank define a bottom, opposite front and back walls and longitudinally opposite end walls. The joints have bellows panels integral with the front, back and end walls, joined at folds oriented diagonally and being glued to one of the adjacent walls to pull one another perpendicular to the bottom when erected. The end walls have an outer end wall panel integrally extending from the bottom and joined adjacent to the front or back to an extension having a protruding tab at its free end for locking into the bottom when the extension is folded over the gusset joint. The cutout in each wall is spaced inwardly from opposite ends and extends only part way from a top edge to the bottom, leaving a lower wall portion adjacent to the bottom at which the material is doubled over and also locked to the bottom. Adjacent to the junction between the extension and the outer end wall, a registration tab is cut in the extension to register with a corresponding opening in the bottom of a container stacked on the container. The extensions can have two or more thicknesses of material folded laterally inward and glued against one another for added reinforcement.

17 Claims, 5 Drawing Sheets

FIG. 1
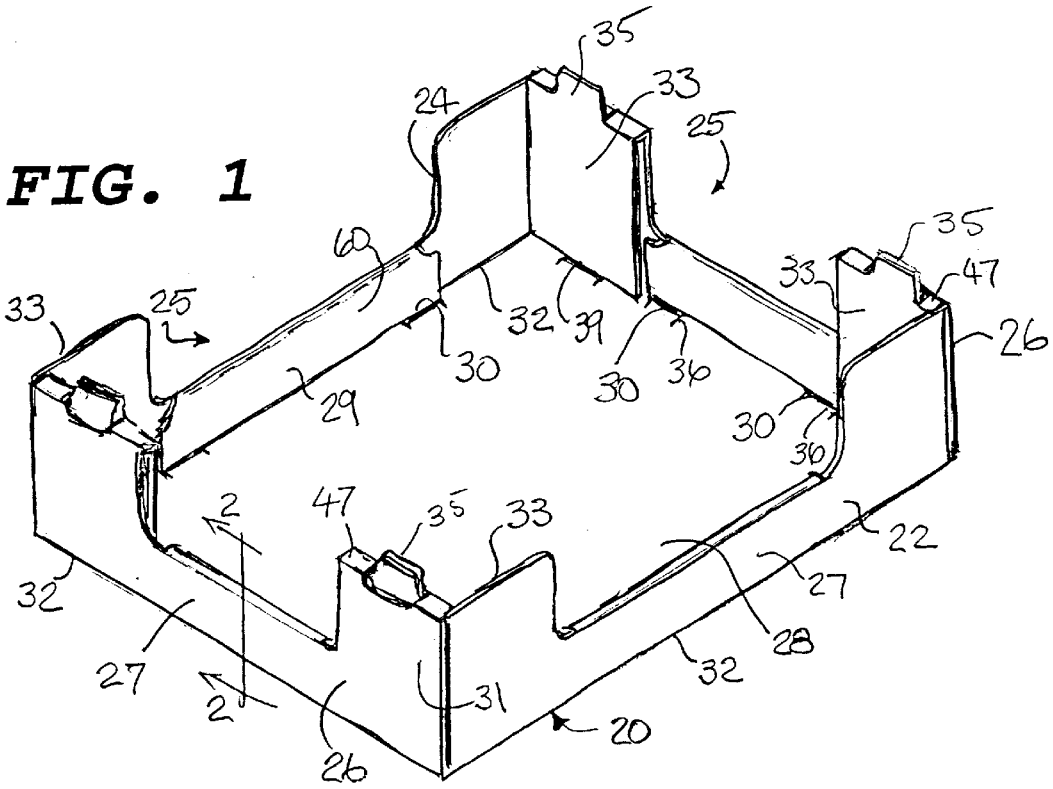
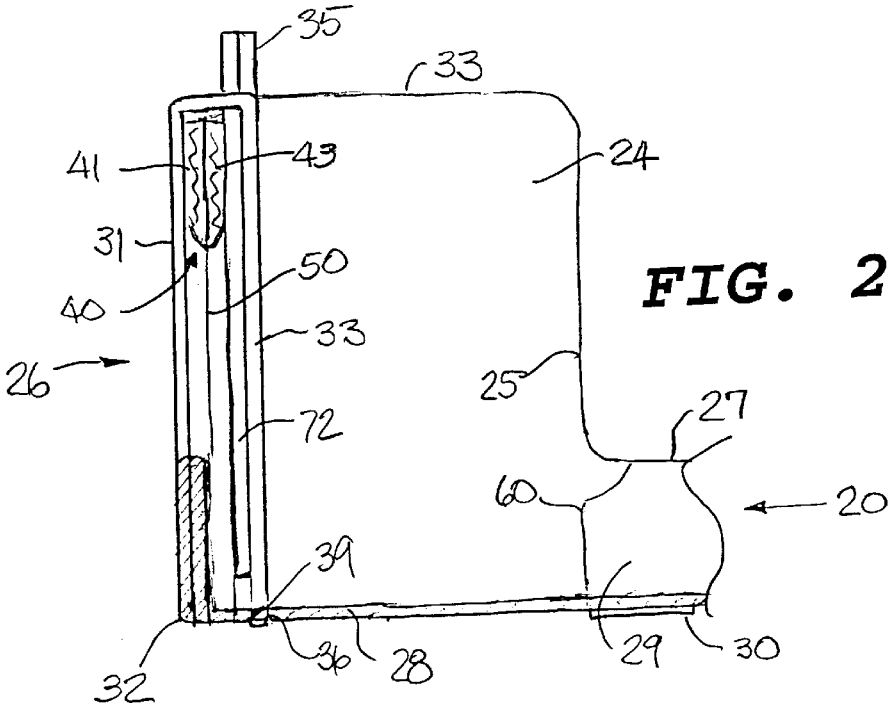
FIG. 2

FOLD AND GLUE STACKING CONTAINER WITH SIDE ACCESS

BACKGROUND OF THE INVENTION

1. Field of the Invention

The invention relates to paperboard, corrugated or similar cartons and containers, made in an automated manner by folding panels of an integral flat blank and gluing the panels at key locations including gusset corner joints. Each gusset corner joint has a back fold glued to one of side or end panels, and erects one of panels (e.g., a side panel) when the adjacent panel (e.g., an end panel) is lifted perpendicular to the bottom from a knocked down flat configuration of the folded/glued blank.

The container is optimized for shopping access, particularly for warehouse-type retail establishments in which products are sold from containers stacked on pallets. Cutouts for manual access to the contents are provided in each of the four side and end panels of the container. The cutouts are spaced inwardly from the corners, leaving panels forming wall portions that meet at the corners. At least at one of the panels at each gusset corner joint, a vertical-reinforcing structure having at least two glued thicknesses of material is folded inwardly and encloses over the associated gusset corner joint. The vertical-reinforcing structure has oppositely directed lock tabs, one attaching the reinforcing structure to the bottom and the other protruding upwardly to engage a container stacked atop the first container. By locking over the gusset corner joint, the container is held in a rectilinear erected shape. The structural integrity of the container against bending or warping of its rectilinear shape is further maintained by edge fold-in panels at each cutout, which also fold inwardly and tab lock into the bottom.

2. Related Art

Corrugated and paperboard containers are made from one or more pieces of flat stock that are cut in required shapes and are assembled to form the walls of a full or partial enclosure. Variations are possible in which several separately-integral parts are formed and then are assembled using glue, tape, staples or the like. For example, the container body and lid may be separate parts, or various types of inserts may be used for reinforcement or other purposes, such as subdividing the volume of the container into discrete areas.

Containers are supplied in a collapsed state because storage or handling of empty containers is wasteful of space. The containers are partly formed, with their parts cut out and certain seams and folds provided. The packer erects the containers prior to loading, and finishes any required assembly steps in the process. The loaded containers may be closed for storage or shipment by a lid formed from integral flaps or a separate piece, as suitable for storage or shipment. For example, a container may be cut out from integral flat stock, folded and scored at spaced parallel lines corresponding to the corners of the container (with at least one seam), and supplied with the opposite side and end walls collapsed flat against one another. Top and bottom flaps are likewise integrally attached to the side and end walls at folds or score lines. The packer erects the container from a flat parallelogram into its rectilinear shape, folding the bottom and top flaps inwardly before and after loading, respectively, and finally closing the container at seams that are taped, glued or otherwise attached.

It is efficient if most or all of the container parts are integral parts and extensions of a single piece of flat material. Separate discrete parts such as separate lids, partitions and reinforcing inserts involve manual assembly steps. Manual assembly steps are costly and consume worker time in several ways. In addition, assembly steps can be physically taxing and may lead to repetitive motion injuries. It is preferable if containers are substantially fully formed when supplied, and require the least possible manual action to deploy, load, close and store or pack the containers for shipment. However it is also important for the containers to be structurally sound.

Cartons or containers formed from paperboard, corrugated craft or similar flat sheet stock material are often stacked on one another during shipping and storage of products. In high volume retail stores, product is not only stored in stacked corrugated cartons, but frequently is presented to consumers in that form, for example with the cartons stacked on pallets. Stacking is obviously efficient as to the use of space, and storing a large quantity of product at a location accessible to the retail purchasers reduces the frequency of restocking. Pallets also enable a number of cartons to be handled efficiently as a unit.

The uppermost remaining carton on a pallet can be opened by removal of its lid. Consumers reach into the packing/shipping carton and withdraw product that is packaged in smaller units. When the cartons on the uppermost level are empty, they are removed and the next lower cartons are opened. It is possible to provide a tear-out opening in the side walls of a carton to facilitate access to the product therein. The tear-out panel provides structural support for the carton and protects the product, until the panel is torn out, normally at perforations defining a window spaced from the comers of the carton, to allow access.

Removal of the tear-out panel removes a substantial part of the structural support for the carton. Therefore, such panels are not removed until a carton is at the stage where consumer access is needed (e.g., on top of a stack). If a carton with a removed tear-out panel is subjected to vertical compression force, for example as occurs in stacking on a pallet, there is a tendency for the end walls of the carton adjacent to the tear-out panel to collapse inwardly toward one another or to splay outwardly because the tear-out panel is not in place to bear compression and tension loads.

Stacked cartons can have protruding tabs that engage in corresponding openings in adjacent cartons such that the cartons are stacked in registry. Stacking tabs help to maintain the integrity of a stack because the vertical walls of stacked cartons are kept in vertical alignment, defining columns in which the vertical walls of each carton are aligned with the corresponding vertical walls of other cartons for bearing vertical compression force. However, even cartons stacked in registry are subject to collapse by their opposite vertical walls becoming diverted inwardly toward one another or splayed outwardly, particularly if the material between such walls is removed by a gap or tear-out panel.

Containers in stacks are subjected to various forces, not limited to vertical compression due to the weight of containers over them in a stack. Such forces (as well as vertical compressive forces) are aggravated by handling, for example transport of a stack on a pallet, manual handling of one or more containers in a stack, etc. Tension and/or compression applied in various directions to the container walls can be sufficient to wholly or partly collapse a container or laterally to deflect, bend or fold the vertically oriented walls of the container. The result is a reduction of structural integrity, and may include crushing or other damage to the container contents. In addition, when the walls of one or more containers in a stack are crushed, wholly or partly collapsed, or otherwise deformed, the deformed container may no longer provide a stable horizontal support for containers stacked over it. The overlying stack may then tip laterally. A leaning "tower" of containers may fall, and even if there is no injury to persons, the contents of the containers may spill or be damaged.

Shipping and retail display cartons having means for improving access to the product in the container are disclosed in U.S. Pat. Nos. 5,839,650 and 5,413,276—Sheffer, which are hereby incorporated. The carton is cut, glued and folded from a flat blank. Sidewall openings are provided such that the customer can reach into the carton from the front or from the top when the carton is opened. The sidewall openings are covered by flaps attached to top panels of the carton such that the openings are uncovered when the top is removed. Two sidewall openings are provided in the same front sidewall, leaving a web of the sidewall between them, which is supported by an internal wall spanning from the back wall to the web at the front wall, to which the internal wall is attached. This carton is apt for pallet displays and the like because it provides protection and support during shipping and access to the product when opened. However once opened, the carton is prone to collapse because the gaps or sidewall openings provided for access reduce the vertical stacking strength of the carton.

Use of pallets of shipping/display containers for storage and display of product at the customer level heightens problems with total or partial collapse of the containers or stacks of containers. For example, in addition to handling by retail/warehouse personnel typically associated with pallets of containers, multiple potential customers have access to and perhaps manipulate stacked containers. Crushed or damaged containers, and merchandise in the containers, are immediately visible to potential customers, reducing the appeal of the product and potentially damaging the reputation of the warehouse retailer or other seller. Falling "towers" of containers and spilled product may disrupt traffic flow, startle customers or cause injuries by virtue of impact or consequential slip and fall incidents.

Apart from instability due to partial collapse of the walls of one or more containers in a stack, instability leading to spills and possible collapse of a stack may be caused by containers being shifted horizontally relative to underlying containers. Customer access and traffic in retail/warehouse stores makes it likely that containers will be shifted horizontally.

Self-erecting paperboard and corrugated containers are known with their respective wall panels and flaps connected in such a way that one or more of the structural parts of the container is pulled into an erected position as the other parts are erected. Commonly owned pending patent application Ser. No. 09/129,375, filed Aug. 5, 1998, entitled Stackable Container, discloses an integral blank container having folded and glued bellows or gusset corners that couple a bottom panel with side and end wall panels. When the container is erected from the knocked-down-flat state, the assembler need only pull on (or otherwise relatively displace) one of the panels, which pulls all of the panels into a rectilinear shape. In another commonly owned pending patent application Ser. No. 09/253,822, filed Feb. 19, 1999, an integral blank container including end walls with spaced inner and outer end wall panels and an upper/edge is disclosed. Advantageously, the end wall panels and ledge encompass hollow erectable support columns that are associated with upwardly protruding stacking tabs. The internal hollow columns, which are supported by folded and glued panels and are opened under the ledge when the container is in an erected state, vertically reinforce the end walls of the container.

U.S. Pat. No. 4,899,929—Grollman, discloses self-erecting bottom flaps connected to container side walls by folded-back glued gusset panels. The gusset panels are arranged to pull the bottom flaps downwardly into a position perpendicular to the side walls when the side and end walls are unfolded from one another during manual expansion of the container from a flattened parallelogram into a rectilinear box.

The foregoing applications include locking tab structures in which a plural thickness tab protrudes upwardly from the structure of the container end wall to engage in an opening in a similar container stacked thereon. One objective of cartons or containers as described is to support the products that have been loaded into the containers, as well as to bear the load of additional containers that may be stacked on a given container. For this purpose, the panels that are folded and glued can include wall panels having multiple thicknesses of glued-together material and/or partition walls that extend between opposite side walls or end walls. These structural reinforcing features add to the vertical stacking strength or load bearing capacity of the container, namely the maximum vertical weight that can be borne without buckling or displacing the container walls. However, the structures added for vertical stacking strength tend to preclude locating a consumer-access gap or sidewall opening in the same location.

What is needed is an optimal carton that provides good access to the product in the carton as well as good vertical stacking strength and vertical self-alignment features.

The present invention, as in the Sheffer pending applications, provides a site-erected container or carton that is at least substantially formed from a folded and glued, knocked-down-flat blank made from an integral flat sheet. Upon erection of the container into a rectilinear shape from the knocked-down-flat configuration, by means of self-erecting gusset corner joints, extensions of the end walls are folded inwardly to enclose around the gusset joints and to lock into the bottom panel. Each of the four corners of the carton is provided with at least one inwardly folded extension, and the extensions are spaced by deep gaps in the associated walls, provided to facilitate customer access.

The end and side walls are simultaneously erected perpendicular to the bottom panel. The gusset panels are compressed and held by the folded-in extensions of the end panel, which holds the container in a rectilinear shape. The end walls are provided with registry tabs on a stacking ledge having a thickness equal to the number of material thickness that are provided in the outer wall panel, glued in the gusset joint, and folded over. In a preferred embodiment, five thicknesses of material are provided to reinforce the container. The container is supplied with substantially all its joints pre-attached but in a knocked-down-flat state.

Preferably, each of the four opposite side and end walls is provided with an opening spaced from the carton corners where such wall is integral with two adjacent walls. At least those walls where the gusset joints are folded flat have folded-in extensions of the end walls. Each of the openings preferably includes a reinforcing edge flap that is folded inwardly from the lower edge of the opening along at least one fold line, and locks into the bottom of the carton. Thus the thickness of the associated wall is at least doubled at the point where the vertical extension of the wall is at a minimum due to the customer access opening. Thus four access openings are provided, the corners are reinforced for vertical stacking and the whole carton is held in a rectilinear shape. For further support and also to subdivide the internal volume of the carton into areas separately associated with each access opening, an X-shaped divider can be coupled into the sidewalls adjacent to the reinforcing folded over panels.

The container can be produced automatically using a fold-and-glue container production machine, for example as available from Bobst Group, Inc., 146 Harrison Avenue, Roseland, N.J. 07068 (affiliated with Bobst, S A, Lausanne, C H). At the loading site the user need only fold the end panels into place, place and lock down the X-shaped internal divider by placing it and folding over the reinforcing panels, and fill the container. The container can be stacked, stored and shipped without attention to tear-out panels, and yet provides very good customer access and has robust structural strength.

SUMMARY OF THE INVENTION

It is an object of the invention to structure a fold-and-glue knocked-down flat container blank so as to provide side and/or end wall openings for customer access without giving up substantial structural strength for vertical stacking and for holding a rectilinear shape in the erected container.

It is another object both to structure the opposite end walls of a container for good stacking strength, including by providing multiple thickness column-like corner structures, and to improve the rectilinear shape of the container and its tendency to stack in registry.

It is an object to deploy a protruding registry tab and to provide a corresponding tab receptacle for stacking cartons, on reinforcing end wall flaps.

These and other objects are accomplished by a preferably one-piece fold-and-glue container with corners reinforced by extensions that fold over and compress self-erecting bellows or gusset corner joints, and cutouts in each of the four front, back and end walls. The corrugated paperboard panels of a single flat blank define a bottom, opposite front and back walls and longitudinally opposite end walls. The joints have bellows panels integral with the front, back and end walls, joined at folds oriented diagonally and being glued to one of the adjacent walls to pull one another perpendicular to the bottom when erected. The end walls have an outer end wall panel integrally extending from the bottom and joined adjacent to the front or back to an extension having a protruding tab at its free end for locking into the bottom when the extension is folded over the gusset joint. The cutout in each wall is spaced inwardly from opposite ends and extends only part way from a top edge to the bottom, leaving a lower wall portion adjacent to the bottom at which the material is doubled over and also locked to the bottom. Adjacent to the junction between the extension and the outer end wall, a registration tab is cut in the extension to register with a corresponding opening in the bottom of a container stacked on the container. The extensions can have two or more thicknesses of material folded laterally inward and glued against one another for added reinforcement.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein:

FIG. 1 is a perspective view of an erected container according to one embodiment of the invention;

FIG. 2 is a partial section view taken along line 2—2 in FIG. 1;

DETAILED DESCRIPTION OF THE PREFERRED EMBODIMENTS

Figure 3:
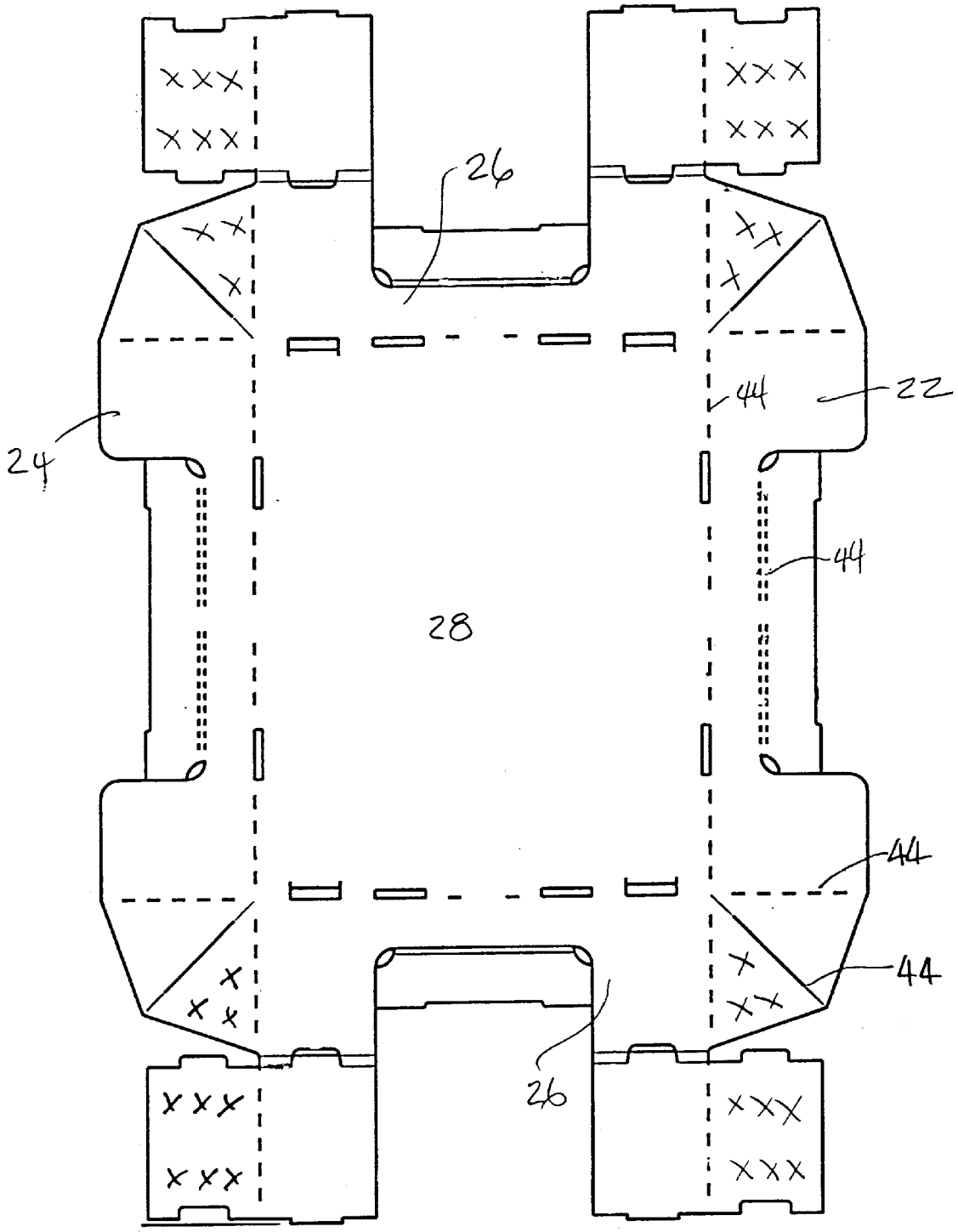
FIG. 3 is a plan view of an integral flat blank prior to being folded, glued, and erected to provide the container shown in FIG. 1.

FIG. 1 shows a vertically reinforced stackable and self-erecting container 20 according to the invention, erected in a rectilinear state and ready for packing. Container 20 defines a rectilinear box including a front wall 22, back wall 24, and end walls 26, each extending perpendicularly upwardly from and integral with a one piece container bottom 28. Walls 22, 24, 26 are connected to container bottom 28 at right angle fold lines 32. Front wall 22, back wall 24 and end walls 26 have outer panels that extend integrally from bottom 28 across the fold lines 32 in a single thickness of material.

Each of the front 22, back 24 and end walls 26 has a cutout 25, namely a relatively large opening in the respective wall provided for manual access, that is, to enable a person to reach into container 20 through the side or end and to remove or add contents. The cutouts 25 are each spaced inwardly from the opposite ends of the respective panel and from the four corners of the container, such that the side and end walls are of full height adjacent to the corners only. Likewise, each cutout 25 extends only part way from the upper edge 33 of the respective wall to bottom 28, thereby leaving a lower wall section 27 of reduced height in the central area of each of the vertical walls. Preferably, the lower wall sections 27 are each doubled in thickness by an inwardly folded reinforcing section 29 that is folded inwardly and has locking tabs 30 at the ends for engaging in corresponding locking tab openings in bottom 28, as explained more fully below.

The full-height sections of the front and back walls 22, 24 adjacent to the corners are of a single thickness in the embodiment shown. However, the full-height sections of the end walls 26 adjacent to the corners are of plural thickness. Adjacent to the corners the end walls 26 have an outer wall panel 31 and an extension 33 that is integral with the outer wall panel 31. Extension 33 folds inwardly over two additional panels of a bellows or gusset joint 40 attaching the outer end wall panel 31 with the front 22 (or back 24) panel. Near the junction of the outer wall panel 31 and extension 33, a registration tab 35 is cut from the material and protrudes upwardly for engagement with a next container in a stack (not shown), and the extreme end of extension 33 has a locking tab 39 that engages an opening 36 in container bottom 28. These locking tabs 39 tend to maintain a vertical orientation of the end wall 26.

Extension 33 can comprise two or more thicknesses of material, as also explained below. Referring to FIG. 2, the result is a corner structure that has at least five thicknesses of material in a locking arrangement that compresses the corner joint and thus holds the container 20 in a rectilinear shape.

The carton of the invention is die cut from a sheet of flat stock, in the configuration shown in FIG. 3, all of the panels forming the bottom 28, front 22, rear 24, ends 26, etc. being integral portions of a single thickness of material and thus joined to one another at abutting edges where the material is folded. It will be appreciated that designations such as "top," "bottom," "front" and "rear," etc. are used in this description for purposes of illustration and to distinguish the relative positions of particular walls and panels. The invention is not limited to any particular orientation of the panels. The lines 44 at which the material is folded are shown in FIG. 3 by dashed lines that indicate longitudinally spaced short score lines or slot-shaped perforations extending part way through the corrugated material, and solid lines that indicate compression or crimping of the material along a line defining a fold. Although perforations, scoring and crimping all can be used to define a fold, crimping or scoring are preferred at certain locations that advantageously have a directional fold. Longitudinally spaced scoring extending through the corrugated material can be directional if the scoring is more extensive on one side (the outside radius) of the fold. Folds can be formed by these and similar known means that weaken the corrugated material along a line.

Figure 4:
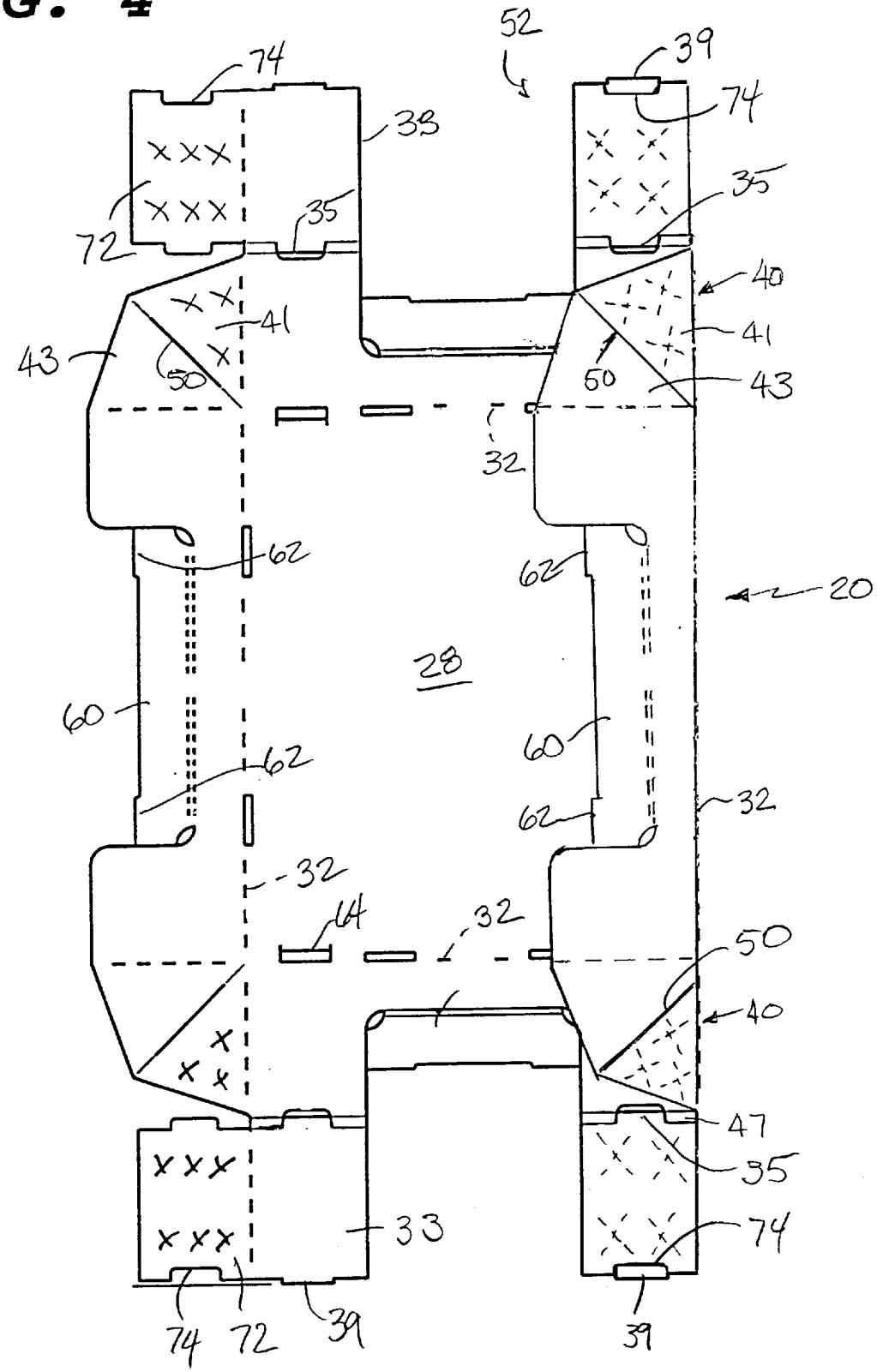
FIG. 4 is a plan view of the integral flat blank of FIG. 3, showing the gluing and folding operations for forming the knocked down flat blank, the right side being shown folded and glued.
Figure 5:
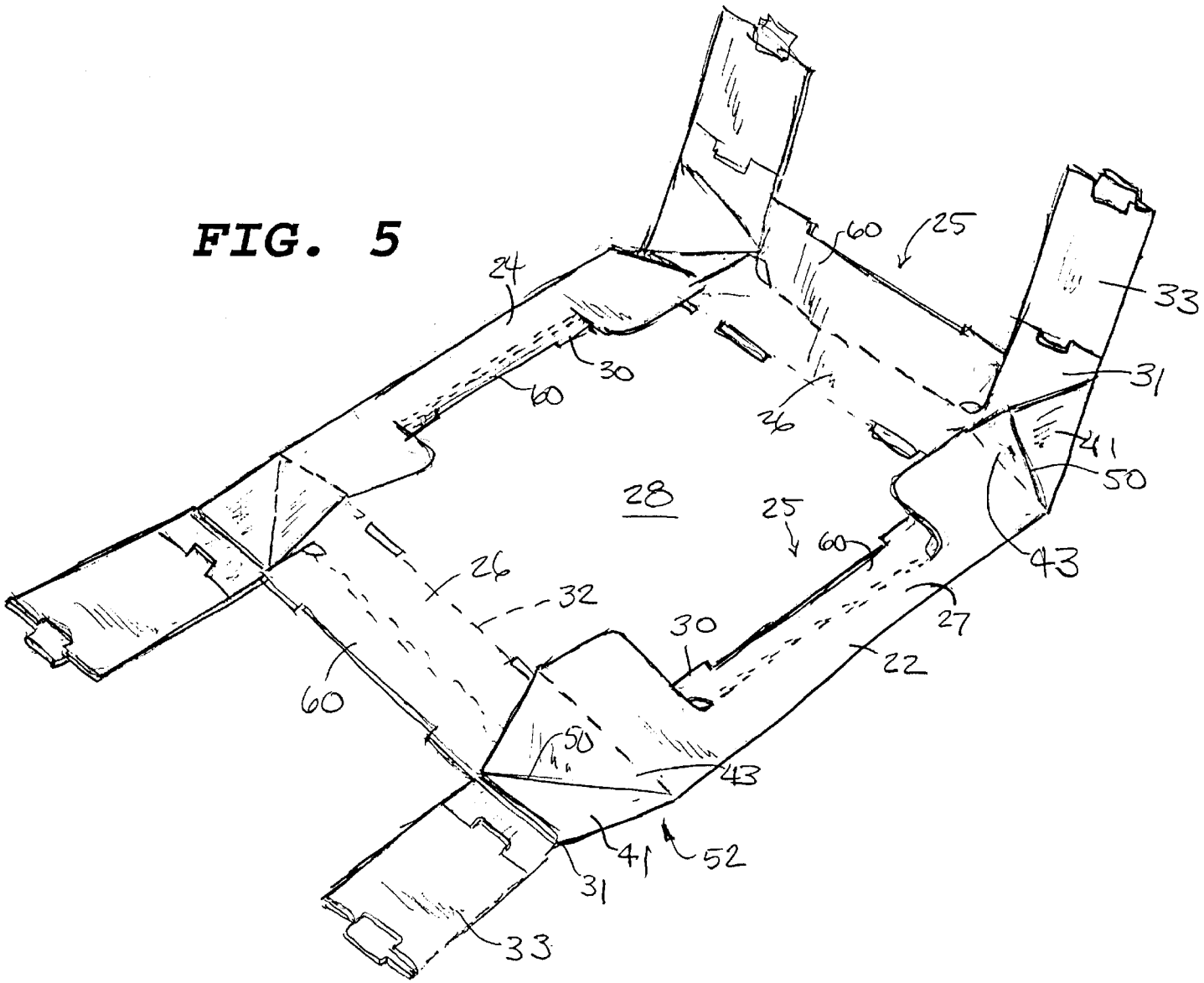
FIG. 5 is a perspective view illustrating erection of the container from the knocked down flat folded and glued blank.

The flat blank is arranged by folding and gluing operations to provide a knocked-down-flat ("KDF") blank 52. FIG. 4 shows the configuration of the cut blank on the left and the KDF blank 52 on the right, and FIG. 5 shows the KDF blank in initial stages of erection. The KDF blank can be provided to a packer in a compact collapsed arrangement and has structures that are attached to one another such that the container is raised into a rectilinear configuration when erected. According to an inventive aspect, these structures additionally are reinforced in a manner that provides vertical reinforcement for the end walls 26, holds the container in a rectilinear shape, and facilitates the registration of stacks of containers.

The front wall 22, back wall 24 and end walls 26 generally comprise a single thickness of material having a cut out portion 25 extending from an upper edge 33 to the top edge of a lower wall panel section. Each of these cutouts 25 has a reinforcing foldover panel 60, namely front and rear foldover panels and an end foldover panels. The reinforcing foldover panels 60 have locking tabs 62 at their opposite ends, which engage in bottom 28 when the container 20 is erected. The foldover panels 60 improve the strength of the cutout wall panels against folding and kinking due to compression forces that are applied, for example, when the container is carrying a substantial weight and is supported exclusively under the bottom at the end walls.

The container 20 is made self erecting by gusset joint or bellows panels 41, 43 provided at each corner, at which the front (or rear) and the end wall are attached by gusset forming webs joined along a diagonal fold 50. The gusset joint panels 41, 43 are collinear with the front 22 (or rear 24) and are folded flat against the end wall 26 in the KDF configuration shown in FIG. 4 (on the right). One of the two joint panels 41 abutting the diagonal fold 50 is glued to the outer end wall panel 31 and the other of the joint panels 43 is not glued. In FIG. 4, glued surfaces are represented by "XXX" figures and panels having glue on their back side are shown by broken "XXX" lines.

When the end wall 26 is raised perpendicular to bottom 28, the glued gusset panel 41 is rotated upwardly around the fold line 32 between bottom 28 and outer end wall panel 31. This pushes the other, unglued gusset panel 43 that is joined to the front 22 (or rear 24) in a longitudinal direction. Inasmuch as the front (rear) is only free to rotate upwardly around its fold line 32 between the front 22 (rear 24) and bottom 28, the gusset joint panels 41, 43 collapse against one another around the diagonal fold 50 as the end wall 26 is brought to vertical (perpendicular to bottom 28). In the process, the front 22 (or rear 24) wall is also brought to a position perpendicular to bottom 28. The carton walls are self erecting in that raising one of the end walls and the front/rear walls to a position perpendicular to bottom 28 also raises the other to perpendicular, and collapses the gusset panels 41, 43 against one another.

As also shown in FIG. 4, the end walls 26 each comprise an exterior panel 31 and an exterior panel forming a longitudinal extension 33 of exterior panel 31. The extension 33 is arranged via two spaced fold lines to wrap downwardly and lock into bottom 28 after the end 26 and front/rear walls 22, 24 are erected. The spacing between these two fold lines defines the longitudinal thickness of a shelf or ledge 47 at the top of the end wall 26.

Although the end wall 26 has a certain thickness in the longitudinal direction (i.e., parallel to the front or rear), stacking of the container with similar containers is facilitated by a die cut registration tab 35 formed at the ledge 47, namely at the fold line between the outer end wall panel 31 and the extension 33 thereof. The registration tab 35 protrudes upwardly when the extension is folded inward to lock in a locking tab opening 64 in bottom 28. this opening 64 in bottom 28 is wide enough to define a corresponding registration tab opening for receiving the registration tab 35 of a second container on which the container bottom is rested. The four registration tab openings in bottom 28 receive the registration tabs 35 at each corner of the container on which the subject container is stacked, thus holding stacked containers in a vertical registered stack.

The registration tab 35 is formed in two thicknesses of material. The extension 33 of the outer end wall panel 31 in the cut blank as shown in FIG. 4 has a lateral reinforcing panel 72 joined to the extension 33 along a longitudinal fold. As shown by the "XXX" glue symbols, the lateral reinforcing panel 33 is folded over and glued in coextensive abutting relationship with extension 33 in the KDF blank. On the distal side of extension 33, the lateral reinforcing panel 72 has an indentation 74 disposed adjacent to the locking tab 39 for locking extension 33 into bottom 28. This indentation 74 forms a part of the registration opening in bottom 28, providing room for a registration tab 35 of two thicknesses of material, plus locking tab 39. In addition to locking tab 39, the registration opening forms a registration tab opening for the next stacked carton.

The extension 33 forms an interior end wall panel at each corner of the erected container, shown in FIG. 1. This interior panel comprises the extension 33 reinforced by the lateral reinforcing panel 72 glued thereto. The double thickness of the panel provides enhanced vertical stacking strength as compared to a single thickness panel. However, according to an inventive aspect, these two glued panels 33, 72 in conjunction with the outer end wall panel 31 also operate to confine the folded-flat gusset joint panels 41, 43 discussed above. As shown in FIG. 2, the end walls at each corner comprise at least five thicknesses of material, namely the outer end wall panel 31, the lateral reinforcing panel 74, two gusset panels 41, 43 and the extension or inner end wall panel 33.

These panels are structurally locked in position when the container is erected and the locking tab 39 is inserted into the locking tab opening 64 (which is also the registration tab opening) in bottom 28. The locking tab opening in bottom 28 is placed so as to provide just sufficient clearance for lateral reinforcing panel and two additional thicknesses, for the gusset joint panels, between folded-in extension and the outer end wall panel. By positively holding the gusset panels 41, 43 folded flat on diagonal fold line 50, the end wall structure positively holds the erected container in a rectilinear shape. Any tendency of the front, rear and end wall panels to splay outwardly (e.g., from vertical forces in a stack) also tends to urge the gusset panels 41, 43 to open on diagonal fold line 50. Such forces are opposed because the gusset panels are sandwiched between the outer end wall panel and extension as reinforced by lateral reinforcing panel and as locked by engagement of locking tab 39 in its opening in bottom 28.

The lower portions of each of the front, rear and end wall panels in the area of the cutouts are likewise structurally locked in place. Each end of the foldover reinforcing panels 60 has a protruding tab 62 that engages in a corresponding opening in bottom 28 and also supports the vertical walls of the container 20.

The cutout portions 25 of the panels provide openings by which the contents of the container can be readily reached manually, namely by reaching through the cutout into the interior of the container. Cutouts as shown can be provided in one of the front, rear and end walls, in an opposed pair such as the front and rear only or the end walls only, etc. Preferably, all four walls 22, 24, 26 have cutouts. As a result, it is possible even when the containers are stacked to reach into the container for access to the contents from any exposed wall.

Figure 6:
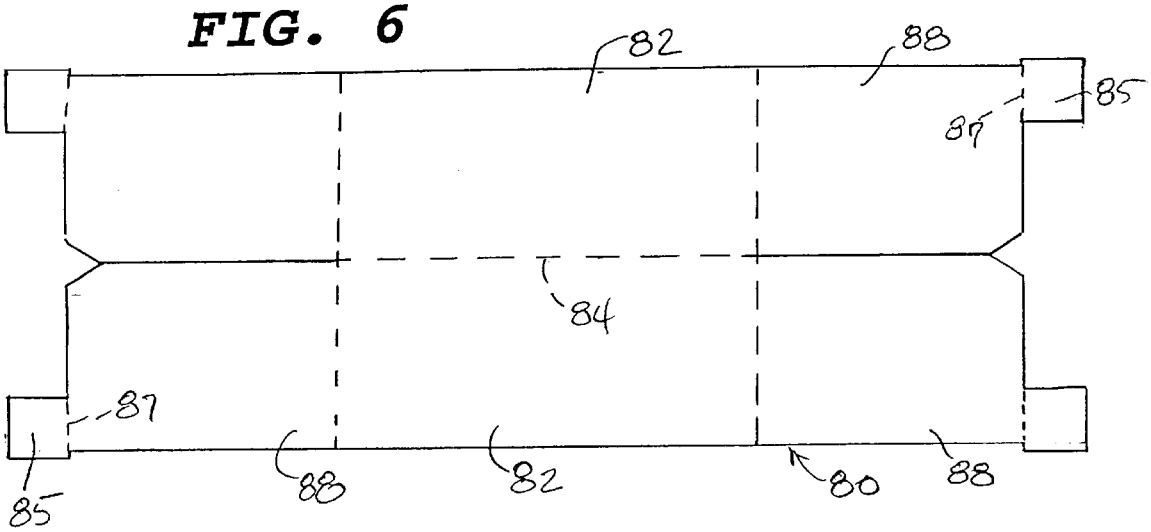
FIG. 6 is a plan view of a four way divider section cut from an integral flat blank.
Figure 7:
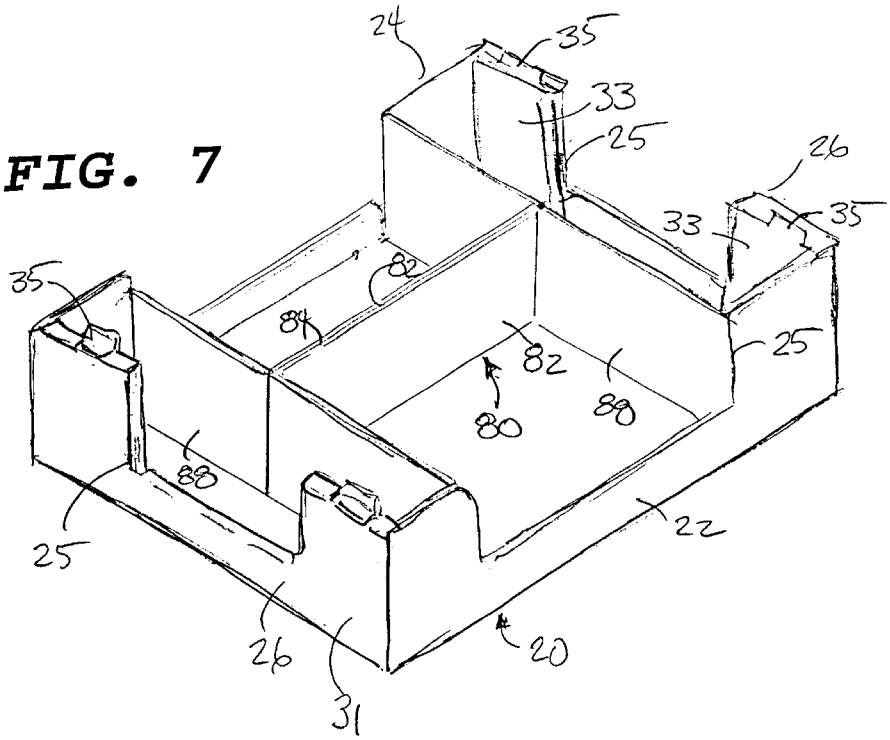
FIG. 7 is a perspective view of an alternative embodiment in which the divider of FIG. 6 is fixed in the erected container of FIG. 1.

FIGS. 6 and 7 shown an alternative embodiment in which the internal area of the carton or container is subdivided by a generally H-shaped internal divider 80 that subdivides the area into four discrete sections. For example, the divider can be a separate part that is not integral with the flat blank from which the remainder of the container was cut as shown in FIG. 3. However the divider 80 itself can be made integrally as shown in FIG. 6, wherein fold lines are again represented by dashed lines, and in this case solid lines represent cut edges. The divider 80 has two central panels 82 that are folded against one another along a central longitudinal line 84 of abutment, thereby providing a central vertical supporting structure of two thicknesses as well as a structure that subdivides the front and rear internal areas of the container. At either longitudinal end, the divider 80 has single thickness legs 88 that are folded at right angles from the central panels 82, and in pairs subdivide the front/rear areas from the end areas.

Preferably the leg portions 88 of divider 80 are locked into the structure of the erected container. The extreme end of each of the legs comprises a mounting tab 85. The mounting tabs 85 are coupled to the remainder of the divider by right angle fold lines 87 such that the mounting tabs 85 are aligned when installed to reside against the front and rear wall panels 22, 24 of the container. In addition, the mounting tabs 85 extend slightly downwardly relative to the lower edges of the central divider panels 82 and the divider legs 88, which rest on the surface of bottom 28. The mounting tabs 85 are placed and dimensioned for insertion into the same locking tab openings in bottom 28 that receive the locking tabs 62 of reinforcing foldover portions 60 of front and rear walls 22, 24. Thus the divider 80 is held in position by insertion of the mounting tabs 85 into the locking tab openings and also by capture of the mounting tabs 85 between the front and rear walls 22, 24 and the folded-over reinforcement panels 60 that are also locked into bottom 28.

In the embodiment shown, the end walls at each comer comprised five thicknesses of material. By adding one or more additional lateral reinforcing panels, for example by extending lateral reinforcing panels outwardly and/or by adding a lateral reinforcing panel on the opposite side of extension from that shown in the figures, the corners can be six, seven or more thicknesses of material. In addition, the reinforcing panels can be glued in facial abutment with extension, or simply placed against extension. Alternatively portions of the lateral reinforcing panels can be diverted at vertical fold lines to provide a combination of solid (facially abutting) and spaced or hollow supporting structures.

The embodiments of the invention as shown are characterized by substantial vertical stacking strength, and resistance to deformation from rectilinear shape that is beyond what could be expected simply by multiplying the thicknesses of vertical structures provided. Nevertheless, the container is easily formed by die cutting the blank of FIG. 3, processing the cut blank through a fold and glue machine such as those available from Bobst Group, Inc. of Roseland, N.J. to apply adhesive and preliminarily fold over the required panels as shown in FIG. 4, whereupon the container can be compactly shipped in its KDF configuration. The container is readily erected on site by simply raising the end walls 26 relative to bottom 28 (and/or raising the front/rear walls), tending also to raise the walls connected thereto by the gusset joints. The end wall extensions and the cutout reinforcing foldovers are then folded in and locked to bottom 28. The reinforcing foldovers for the front and rear can be folded over after placing an internal divider 80 as shown in connection with that particular embodiment.

The container can be loaded with product, stacked and shipped, stored and presented to customers who can readily withdraw product from the container through the cutouts. In the embodiment in which the container contents are subdivided, the respective subdivided areas can be advantageously used, for example, to contain different flavors of a given product, to contain complementary types of products, or otherwise used to the advantage of the retailer and the convenience of the customer.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A container comprising:

a plurality of panels defining a bottom, a laterally opposite front wall and back wall and longitudinally opposite end walls;

a gusset joint coupling the front and back walls with adjacent ones of the end walls at four corners of the container, the gusset joint comprising two joint panels, the joint panels being respectively joined to one of said front and back walls and to the adjacent one of the end walls, the joint panels being coupled to one another at a diagonal fold and one of the joint panels being folded against and glued to one of said front and back walls and said adjacent one of the end walls, whereby the gusset joint, when one of said front and back walls and said adjacent one of the end walls is raised to a position perpendicular to the bottom, to carry the other of said front and back walls and said adjacent one of the end walls to a position that is likewise perpendicular to the bottom in a rectilinear erected state of the container, said joint panels being folded flat against one another at the diagonal fold when the container is in the rectilinear erected state;

wherein one of said front and back walls, and said end walls, comprises an extension that encloses over the gusset joint in the rectilinear erected state of the container, and holds said joint panels flat against one another, whereby the extension holds the container in the rectilinear state;

wherein at least one of the front wall, back wall and end walls has a cutout spaced inwardly lateral edges thereof, for manual access to contents of the container;

wherein the cutout extends only part way from a top edge of said one of the front, back and side walls to the bottom, and further comprising a reinforcing panel folded inwardly along an edge of the cutout such that said one of the front, back and side walls is at least a double thickness from the cutout to the bottom; and, wherein each of the front wall, back wall and end walls has a said cut out disposed at a space between respective corners thereof, said gusset panels being folded against a reinforced pair of one of said end walls and said front and back walls, and each of the cutouts has a said reinforcing panel.

2. The container of claim 1, wherein the front wall, back wall and at least part of the end walls are integral with the bottom.

3. The container of claim 2, wherein the panels of the gusset panel each are integral with an associated one of the front wall, back wall and said at least part of the end walls.

4. The container of claim 1, wherein the end walls comprise an outer panel integrally extending from the bottom and wherein said extension integrally extends from the outer panel.

5. The container of claim 1, wherein the gusset panels are folded against the end walls in the rectilinear state of the container and the extension extends vertically over the gusset panels.

6. The container of claim 5, wherein the extension comprises a locking tab that engages with at least one of the bottom, the side wall and the gusset panels when the extension is folded over the gusset panels.

7. The container of claim 6, wherein the bottom comprises a tab receptacle and the tab locks in the tab receptacle in the rectilinear state of the container.

8. The container of claim 1, wherein the cutout is disposed between corners of the container, each said corner comprising said extension enclosing said gusset panel at said corner.

9. The container of claim 8, wherein each of the front wall, back wall and end walls are each cut out at a space between respective corners, said gusset panels being folded against a reinforced pair of one of said end walls and said front and back walls.

10. The container of claim 9, wherein the reinforced pair comprises an outer wall panel, said gusset panels and said extension.

11. The container of claim 10, wherein the extension comprises a first thickness of material extending from the outer wall panel and a second thickness of material folded laterally inwardly over the first thickness.

12. The container of claim 11, wherein the first and second thicknesses are adhesively attached together.

13. The container of claim 9, further comprising a divider having a plurality of panels subdividing the container into a plurality of areas, each of the areas being associated with one of said cutouts.

14. The container of claim 1, wherein the reinforcing panel comprises a protruding tab and is locked into a corresponding tab receptacle in the bottom.

15. The container of claim 1, further comprising a registration tab cut protruding upwardly from the extension, and wherein the bottom has a registration opening complementary to the registration tab, such that said container is stackable in registry with similar said containers by engaging the registration tab of one said container with the registration opening of a similar said container stacked thereon.

16. The container of claim 1, further comprising a divider having a plurality of panels subdividing in the container at least one area associated with one of the cutouts.

17. A container comprising:

a plurality of corrugated paperboard panels defining a bottom, a laterally opposite front wall and a back wall, and longitudinally opposite end walls, said panels being integral parts of a single piece of flat stock;

a plurality of inwardly folded bellows panels integral with the front, back and end walls, in pairs of panels each defining a gusset joint, each gusset joint having a fold oriented substantially diagonally relative to an adjacent one of the end walls and the front and back and being glued to said adjacent one of the end walls, whereby the bellows panels and the end walls pull one another perpendicular to the bottom when erected;

wherein the end walls comprise an outer end wall panel joined adjacent to a respective one of the front and back walls to an extension at each opposite end of each of the end walls, each said extension being foldable over one of said pairs of panels defining the gusset joint, the extension having a locking tab engaging in the bottom such that the extension encloses against the gusset joint;

wherein each of the front, back and end walls has a cutout spaced inwardly from opposite ends thereof, extending part way from a top end toward a lower wall portion adjacent to the bottom, and wherein each said lower wall portion comprises a folded-inward reinforcing web having a locking tab that engages in a corresponding locking opening in the bottom; and, wherein each said extension comprises at least two thicknesses of material folded and glued against one another, whereby each of the corners is supported by at least an outer end wall thickness, said two thicknesses of the extension and said pair of panels defining the gusset joint.

* * * * *